US007927439B1

(12) United States Patent
Forbes et al.

(10) Patent No.: US 7,927,439 B1
(45) Date of Patent: Apr. 19, 2011

(54) SHOCK COMPRESSION SENSITIVITY CHANGE ON COMMAND OF EXPLOSIVES CONTAINING SMART MATERIALS

(75) Inventors: Jerry W. Forbes, Port Tobacco, MD (US); Chak P. Wong, Silver Spring, MD (US); G. William Lawrence, Silver Spring, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 383 days.

(21) Appl. No.: 12/228,323

(22) Filed: Aug. 8, 2008

(51) Int. Cl.

| | |
|---|---|
| ***C06B 45/00*** | (2006.01) |
| ***C06B 45/04*** | (2006.01) |
| ***D03D 23/00*** | (2006.01) |
| ***D03D 43/00*** | (2006.01) |

(52) U.S. Cl. ..... 149/109.4; 149/2; 149/17; 149/108.2; 149/108.8

(58) Field of Classification Search ..... 149/109.6, 149/2, 17, 108.2, 108.8, 109.4
See application file for complete search history.

(56) References Cited

U.S. PATENT DOCUMENTS

| | | | | |
|---|---|---|---|---|
| 6,214,137 | B1 * | 4/2001 | Lee et al. | 149/19.7 |
| 6,669,753 | B1 * | 12/2003 | Chambers et al. | 71/59 |
| 7,088,198 | B2 * | 8/2006 | Simon et al. | 333/24 R |

OTHER PUBLICATIONS

Judy Lin-Eftrkhar, Materials on the Move Engineering SMART Materials, http://www.enginerr.ucla.edu/magazine/USsp02.pdf.
Geoffrey P. McKnight,UCLA, Magnetostrictive Materials Background,http://aml.seas.ucla.edu/home.htm.

* cited by examiner

*Primary Examiner* — James E McDonough
(74) *Attorney, Agent, or Firm* — Frederic J. Zimmerman

(57) ABSTRACT

The invention is a method and a composition where, on command, a distributed number of micron size voids are created in an energetic material. The voids are hot spots, which change the shock compression sensitivity of the explosive composition by a factor of 2 to 10. The composition contains SMART materials, which are magnetostrictive materials having a large magnetostrictive coefficient, and in a matter of microseconds following the application of an external electromagnetic field, each of the magnetostrictive nano-structures expands and contracts forming a void, where the sum of the voids increases the shock compression sensitivity of the composition.

10 Claims, 1 Drawing Sheet

SHOCK COMPRESSION SENSITIVITY CHANGE ON COMMAND OF EXPLOSIVES CONTAINING SMART MATERIALS

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention relates generally to energetic materials, and in particular to a method and a composition to substantially instantaneously changing the shock compression sensitivity explosives, propellants, and the like through the compounded addition of distributed SMART materials and the application of an external electromagnetic field.

2. Description of the Related Art

Geoffrey P. McKnight, in a UCLA paper entitled MAGNETOSTRICTIVE MATERIALS BACKGROUND teaches that magnetostrictive materials are broadly defined as materials that undergo a change in shape due to a change in the magnetization state of the material generally these materials are referred to as "SMART Materials." Nearly all ferromagnetic materials exhibit a change in shape resulting from magnetization change. In most common materials, nickel, iron, and cobalt, the change in length is on the order of 10 parts per million (see FIGURE at right). In addition, the change in volume is very small. This type of magnetostriction has been termed Joule magnetostriction after James P. Joule's discovery in the 1850's. The relatively small change in shape of these materials limited their use in engineering. Initial sonar designs contemplated exploiting the magnetostrictive effect, but were left unexplored due to advances in piezoelectric materials such as quartz and Rochelle salt, and later lead zirconium titanate (PZT). The engineering era of magnetostrictive materials began with the discovery of giant (1000's of ppm) magnetostriction in rare earth alloys during the 1960's by A. E. Clark and others. The culmination of research into an engineering alloy incorporating rare earth materials was Terfenol-D, a specially formulated alloy of Terbium, Dysprosium, and Iron that exhibits large magnetostriction at room temperature and relatively small applied fields. Earlier alloys exhibited large magnetostriction, but either at very large magnetic fields, or at cryogenic temperatures, or both. Terfenol-D overcame the temperature difficulty by incorporating a $RFe_2$ microstructure which raised the curie temperature above room temperature. The necessary magnetic field was reduced by balancing the ratio of Terbium and Dysprosium, two elements with oppositely signed magnetocrystalline anisotropy, such that effective anisotropy of the compound was near zero at room temperature. Since this time, Terfenol-D has become the preeminent magnetostrictive material, although research continues into new materials constantly.

Judy Lin-Eftekhar in a UCLA paper entitled MATERIALS ON THE MOVE: ENGINEERING SMART MATERIALS reports an innovation at UCLA, was the creation of a NiTi "microbubble" that can function as a two-way actuator. Starting out as a perfectly flat disk, it plumps up into a bubble when electric current is passed through the NiTi, heating the material up. When the current is turned off, the bubble recedes and the disk resumes its original shape.

SUMMARY OF THE INVENTION

The invention is a composition and a method that on command creates distributed micron size voids in an energetic material, such as an explosive and the like. Initiation of an energetic material or high explosive can occur when an impulse delivered to the material evolves into a self-sustaining detonation wave. Wave growth towards detonation depends on the formation of local regions of elevated thermal energy or hot spots, where local temperatures can be much higher than the bulk temperature expected from shock heating. When sufficient thermal energy is generated locally, ignition occurs, and subsequent chemical energy release results in progressive shock strengthening until detonation conditions are achieved. A site where such energy focuses (a hot spot) can occur at a void in the material. Porosities or voids in heterogeneous explosives offer potential sites for the initiation of detonations. The instant invention is a method for creating distributed voids on command and a composition of an heterogeneous energetic material.

The voids are produced by the addition of magnetostrictive (also "magnetostriction") materials generally referred to as "SMART materials," and in particular giant magnetostrictive materials (GMM), such as alloys composed of iron, dysprosium and terbium, creating an explosive composite with tunable sensitivity to shock ignition. Giant magnetostrictive materials, which are nano-structures, are selected which increase in volume a few percent when subjected to an external electromagnetic field, therein pushing the surrounding energetic material away during expansion of the magnetostrictive material composed of individual nano-structures. When the external electromagnetic field is removed the magnetostrictive material returns to its original volume, thus leaving behind voids in the explosive composition. These voids constitute sites where shock compression energy focuses creating hot spots, which results in progressive shock strengthening until detonation conditions are achieved. Creation of voids can be produced by magnetostrictive rods, and other shapes of SMART materials such as disks, microbubbles, spheres and other volume changing nano-structures. When a special visco-elastic binder system is employed the induced voids are collapsible, and voids disappear after a few hours due to stress relaxation returning the composite explosive to its safe state, being substantially free of voids. The exemplary SMART materials are generally metals that provide fuel to the reaction process providing energy and maintaining the performance level of the host energetic material.

The invention is additionally a method for substantially instantaneously changing the shock compression sensitivity. The method comprises the steps of providing a composition of energetic material and a SMART material, wherein said SMART material is a potential fuel; applying an external electromagnetic field to the composition, said field causing the SMART material distributed throughout the composition to expand from its relaxed normal state to a strained expanded state, which displaces a region of the energetic material adjacent to the SMART material nano-structure; and removing the external electromagnetic field, whereupon the SMART material nano-structure returns to its normal state creating a void in the region previously occupied by the nano-structure that was strain expanded, where said resulting void is a hot spot that enhances the shock compression sensitivity of the energetic material. From this point forward the process can take either one of two paths. The energetic material having enhanced shock compression sensitivity can be detonated, for instance in a new booster material or an explosive, or the energetic material can be allowed to rest undisturbed for several hours, providing time for the energetic material to stress relax filling the voids, thereby making the composition safe to handle. The energetic material can always be re-activated at a later date by re-applying the external electromagnetic field to the composition.

BRIEF DESCRIPTION OF THE DRAWINGS

The foregoing invention will become readily apparent by referring to the following detailed description and the appended drawings in which.

DESCRIPTION OF THE INVENTION

Figure 1:
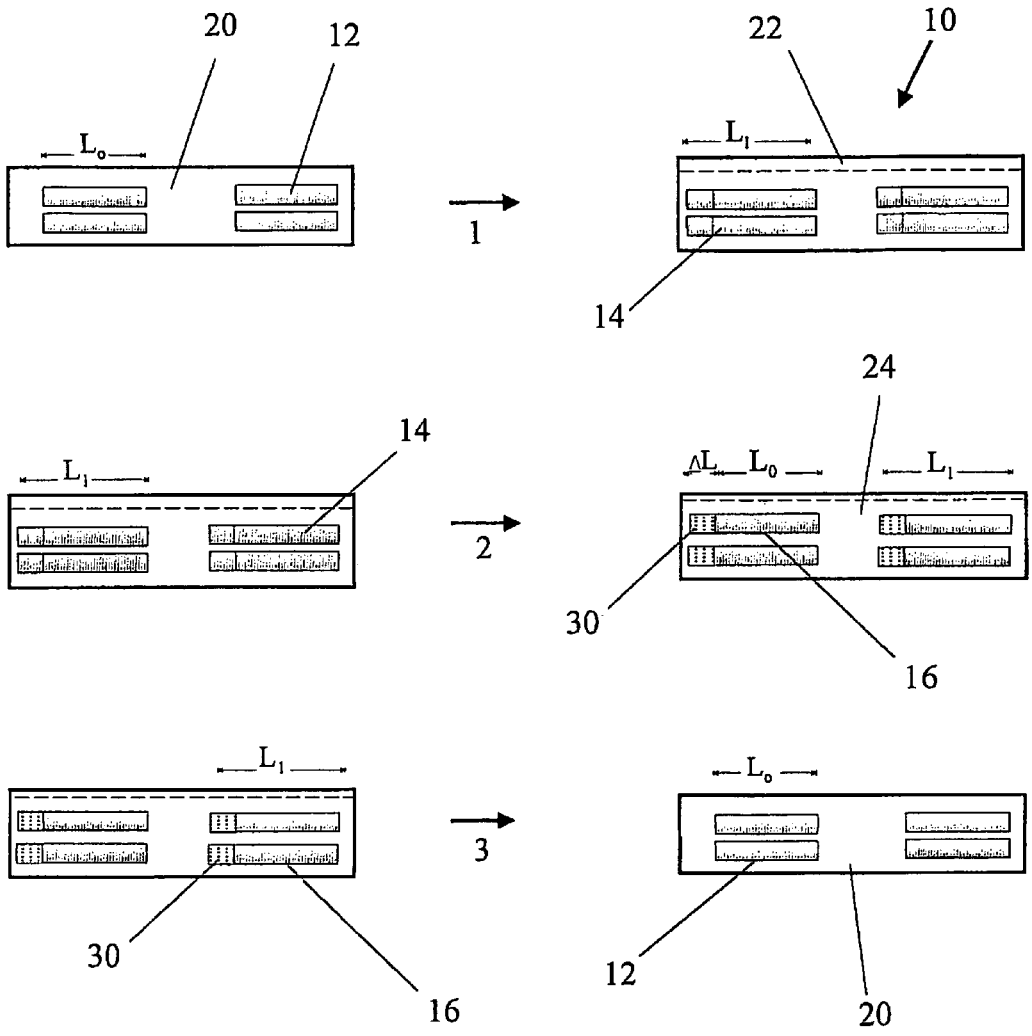
FIG. 1 is a diagrammatic illustration of a method, in an exemplary embodiment, for forming temporary voids in explosive materials, such as, cyclotetramethylenetetraamine (HMX) and the like, having a high theoretical maximum density using SMART materials, such as, giant magnetorestrictive materials (GMM) in the form of rods.

The invention is a method and a composition to substantially instantaneously create distributed micron size voids in an energetic material. Referring to FIG. 1, the method 10 includes two main steps and an elected third step. In the first step, energetic material 20, in the illustrated embodiment, cyclotetramethylenetetraamine (HMX) is combined with a SMART material 12, in an exemplary embodiment, nanostructures known as a giant magnetostriction materials (GMM). GMM increases in volume by a few percent compared conventional magnetostriction materials, which strain expand a few tenths of a percent. In an exemplary embodiment, the GMM is composed of Terefenol-D with magnetostriction coefficients, of L(100)=90 ppm and L(111)=1600 ppm, which is a "large" magnetostriction coefficient. Magnetostriction is dependent on crystallographic directions. The term magnetostriction coefficient refers to the magnetostriciton values measured for certain crystallographic directions, that is, a magnetic constant of a material. The magnetostriction in any direction may be expressed as a function of the magnestrictions measured for these directions, e.g., for cubic crystal systems like Terefenol. The magnetostriction in a general direction may be expressed in terms of those measured for the 100 and 111 crystallographic directions, that is, in terms of L(100) and L(111) indicated above. Accordingly, large magnetostriciton values would be obtained if measurements are performed in certain directions along the 111 directions.

As shown in the FIG. 1, the SMART material are giant magnetostriction materials in the form of rods, but other volume strain expanding shapes will also work. The composition has a theoretical maximum density (TMD) from about 98.3% to about 99.4% primarily or substantially due to a presence of the HMX. Generally, a TMD is reached with a composite without any voids. Nonetheless, a TMD may be calculated for a composition or mixture of HMX and a binder at atmospheric room and temperature. Although a 100% TMD cannot be reached with explosives, pressed explosives may have a range from about 98.3% to about 99.4% but cast explosives have a lower TMDs due to the existence of air pockets. The inventive technology works best at the higher range of TMDs.

In step one (1), an external electromagnetic field is applied to the composition. The field causes the SMART material 12, in an exemplary embodiment, rod to lengthen from an initial length $L_0$ to a strained expanded rod 14 having an expanded length of $L_1$. The expansion may also result in a small increase in an overall volume of the composite 22 as depicted by a dimensional section above a dotted line, which represents an initial volume dimension. In the second step the external electromagnetic field is removed, and the rod returns to its original size having a length $L_0$. Each individual rod of SMART material creates a void 30 which is a hot spot having a length $\Delta L$, where $\Delta L$ is on the order from about 10 to about 100 microns. The rod with the adjacent void 16 imparts enhanced shock compression sensitivity to the performance enhanced energetic material 24. The performance enhanced energetic material 24 can be detonated or given sufficient time, generally on the order of hours, the energetic material will stress relax therein collapsing the voids. This step is illustrated in step 3, where the hot spots are eliminated, thereby making the energetic material 20 again safe to handle. The rods 12 are no longer in a strain expanded state, but may be expanded again to create voids in a future application of the external electromagnetic field.

The magnetostriction material includes alloys composed of iron, dysoprosium and terbium, such as, $TbFe_2$, TbZn, and TbDyZn. In addition to rods, the magnetorstrictive material may also be spheres, disks, microbubbles, and other volume changing shapes.

In an exemplary embodiment, the energetic material is cyclotetramethylenetetraamine (HMX) and the like. HMX is a class 1 explosive, but is relatively stable with respect to shock compression sensitivity. The inclusion of SMART materials lowers the pressure required to detonate HMX on the order of 2-10 fold when voids are generated. The voids are on the order from about 10 to about 100 microns.

It is to be understood that the foregoing description and specific exemplary embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

Finally, the numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What we claim is:

1. A composition, comprising:

an energetic material; and a SMART material, wherein said SMART material is a magnetostrictive material, and wherein said magnetostrictive material includes a large magnetostriction coefficient of about 1600 ppm.

2. The composition according to claim 1, wherein said magnetostrictive material is a giant magnetostrictive material (GMM).

3. The composition according to claim 2, wherein said magnetostrictive material is an alloy comprised of iron, dysoprosium and terbium.

4. The composition according to claim 1, wherein said SMART material is configured of at least one shape selected from rods, spheres, disks, microbubbles, and other magnetostrictive volume changing geometric configurations.

5. The composition according to claim 2, wherein said giant magnetostrictive material expands a few percent from a relaxed normal state to a strained expanded state when subjected to an external electromagnetic field.

6. The composition according to claim 1, wherein said energetic material is comprised of cyclotetramethylenetetraamine (HMX).

7. The composition according to claim 6, wherein said composition includes a theoretical maximum density (TMD) from about 98.3% to about 99.4%.

8. The composition according to claim 4, further comprising a visco-elastic binder system, wherein the energetic material stress relaxes, flows and collapses the voids.

9. The composition according to claim 1, wherein said SMART material is comprised of an alloy, and wherein said alloy is oxidized in a presence of an ignited composition, and thereby contributes as a performance quality fuel to the composition, which is a heterogeneous composition.

10. The composition according to claim 1, wherein said composition is selected from one of an explosive and a booster material.

* * * * *